United States Patent [19]

Kikis

[11] Patent Number: 4,526,372

[45] Date of Patent: Jul. 2, 1985

[54] PUZZLE TOY

[76] Inventor: Evangelos T. Kikis, 143-57 Rose Ave., Flushing, N.Y. 11355

[21] Appl. No.: 463,649

[22] Filed: Feb. 3, 1983

Related U.S. Application Data

[62] Division of Ser. No. 341,061, Jan. 20, 1982, abandoned.

[51] Int. Cl.[3] ..... A63F 9/08

[52] U.S. Cl. ..... 273/153 S

[58] Field of Search ..... 273/153 R, 153 S, 155, 273/241, 281; 46/43

[56] References Cited

U.S. PATENT DOCUMENTS

| | | | |
|---|---|---|---|
| 507,215 | 10/1893 | Churchill | 273/153 S |
| 1,085,050 | 1/1914 | Lathrop | 273/153 S |
| 1,257,205 | 2/1918 | Fallace | 273/153 S |
| 1,336,541 | 4/1920 | Shepherd | 273/153 S |
| 2,043,506 | 6/1936 | Costigan | 273/153 R |
| 2,974,957 | 3/1961 | Steinhardt | 273/153 S |
| 3,081,089 | 3/1963 | Gustafson | 273/153 S X |
| 3,677,547 | 7/1972 | Hicks | 273/153 S X |
| 3,690,672 | 9/1972 | Dreyer | 273/155 |
| 3,726,527 | 4/1973 | Schauffler | 273/241 X |
| 4,344,623 | 8/1982 | Isobe | 273/153 S |

FOREIGN PATENT DOCUMENTS

| | | | |
|---|---|---|---|
| 8110092 | 10/1981 | Fed. Rep. of Germany | 273/153 S |
| 170062 | 12/1977 | Hungary | 273/153 S |
| 55-8192 | 3/1980 | Japan | 273/153 S |
| 55-8193 | 3/1980 | Japan | 273/153 S |

*Primary Examiner*—Anton O. Oechsle

*Attorney, Agent, or Firm*—Jacobs & Jacobs

[57] ABSTRACT

A game comprising a three-dimensional support having intersecting, separate, endless courses, and the courses are filled with game pieces that can be moved through a point of intersection between two courses and either be transferred from one course to another or remain on their original course.

2 Claims, 7 Drawing Figures

FIG. 1
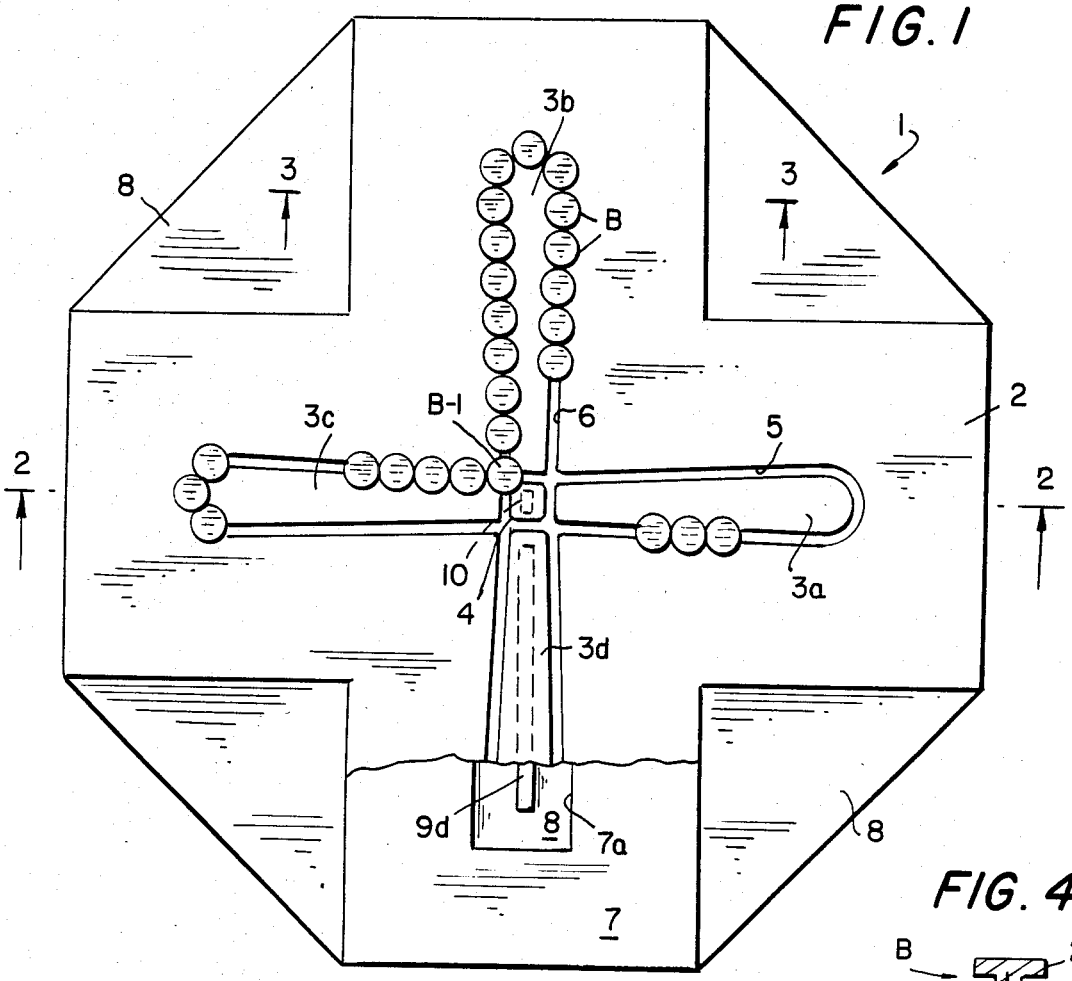
FIG. 4
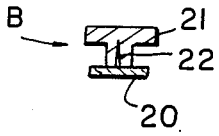
FIG. 2
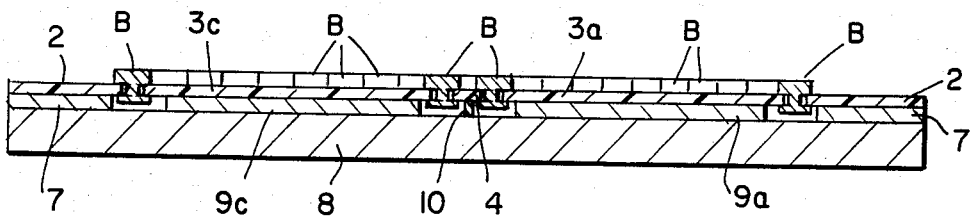
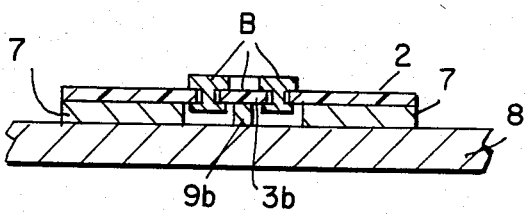
FIG. 3

PUZZLE TOY

CROSS-REFERENCE

This is a division of Ser. No. 341,061 filed Jan. 20, 1982, abandoned.

The present invention relates to a game that is suitable for enjoyment on a variety of levels. It may be used as a mathematical puzzle or game or as an aid in teaching pattern design.

Many games or puzzles having movable parts have been proposed, such as Hungarian Pat. No. 170,062 to Erno Rubik. Other manipulatable toys and games are also known such as U.S. Pat. Nos. 3,081,089 to Gustafson, 3,690,672 to Dreyer, and Japanese Patent specification Nos. 55-8912 and 55-8913.

It has also been known to provide games or puzzles in which game pieces are placed into grooves, such as U.S. Pat. No. 2,043,506 to Costigan, or in which game pieces move within tracks or grooves, such as U.S. Pat. Nos. 2,974,957 to Steinhardt and 3,677,547 to Hicks.

The present invention now provides an entirely new concept for a puzzle game, which comprises, in its simplest form, two endless tracks, each defining a separate endless course, and a plurality of game pieces that occupy substantially the entire extent of the tracks and are movable along the tracks. Thus, all of the game pieces in a given course are moved along that course by sliding any one game piece in a given direction. The two tracks intersect each other in at least two transfer points, which are designed so that the game pieces can pass through a transfer point and either change courses or stay in their original course.

The pieces are initially arranged in a predetermined "start" position, such as having red pieces in one track and blue pieces in another track. By moving the pieces in each course randomly, the "start" pattern is disrupted as pieces move from one course to the other in a random fashion. The puzzle is "solved" by restoring the pieces to their original pattern.

The game according to the present invention can provide two or more intersecting, coplanar endless tracks, in which case a two dimensional toy is provided, or the intersecting endless tracks may run along the surface of a three dimensional object, such as the great circles of a sphere, to provide a three dimensional game.

The present invention is illustrated in terms of its preferred embodiments in the accompanying drawings, in which:

FIG. 1 is a top plan view of a two dimensional game according to the invention, with a part broken away;

FIG. 2 is an elevational view in section, taken along lines 2—2 of FIG. 1;

FIG. 3 is an elevational view in section, taken along lines 3—3 in FIG. 1;

FIG. 4 is an enlarged detail view of a game piece;

Figure 5:
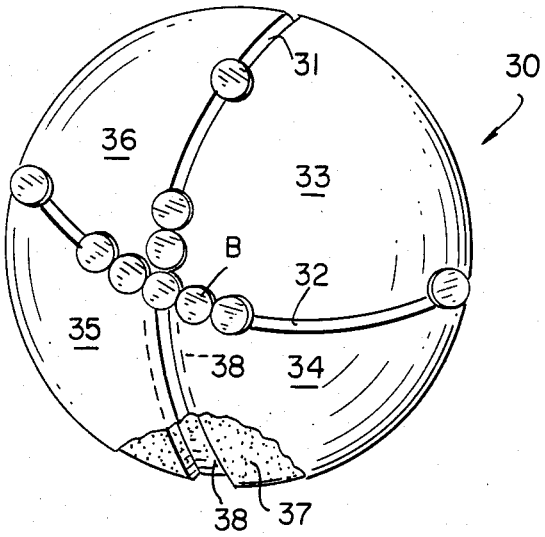
FIG. 5 is a perspective view with a part broken away, of another embodiment of the invention.

As shown in FIG. 1, puzzle game 1 has a top face 2 of cruciform shape and a plurality of playing pieces B arranged in a generally cruciform pattern. Four elongated interior portions 3*a*, 3*b*, 3*c*, 3*d* and a substantially small interior portion 4 are coplanar with but spaced from top face 2 to form two intersecting endless tracks 5 and 6. Playing pieces B are disposed in tracks 5 and 6 for sliding movement, as will be described hereinafter. In the most preferred embodiment of the invention, tracks 5 and 6 are filled with circular playing pieces B so that each piece B touches (or almost touches) the two pieces on either side. As seen in FIG. 4, each piece B has a lower portion 20 that is secured to upper portion 21 by means of pin 22 carried by lower portion 21.

Top face 2 is mounted on support member 7, which is also of cruciform shape having an interior, cruciform aperture 7*a* (FIG. 1). Preferably, support member 7 is closely adjacent to tracks 5, 6, but not so close as to interfere with the movement of pieces B as they slide along the tracks. Support member 7 is in turn mounted on base 8. Interior portions 3*a*–3*d* are mounted on elongated auxiliary support members 9*a*–9*d*, respectively, which are carried by base 8, and interior portion 4 is mounted on auxiliary support member 10, also carried by base 8.

In the embodiment shown, interior portion 4 is a square of such dimensions that the four pieces B which are at the four intersections of tracks 5, 6 will enclose interior portion 4. However, interior portion 4 can be of any desired quadrilateral shape, depending upon the angle at which the tracks intersect and the distances between the points of intersection.

To assemble the puzzle game 1, support members 7, 9*a*–9*d* and 10 are secured to base 8. Top 2 and interior portions 3*a*–3*d* and 4 are arranged on a convenient surface to form tracks 5 and 6, and the upper portions 21 of pieces B are fitted into the tracks. Thereafter, lower portions 20 are secured to upper portions 21, whereby the pieces B are held in place in tracks 5, 6. The assembly of game 1 is completed by mounting the sub-unit of tracks and pieces on support members 7, 9*a*–9*d* and 10. Preferably, the mounting of top face 2 and interior portions 3*a*–3*d* and 4 is by means of a slow-setting adhesive to permit fine adjustments, where necessary.

In the most preferred embodiment of the invention, tracks 5 and 6 are completely filled with pieces B. Hence, moving one piece B along a given track moves all of the pieces then in the track. Since the tracks 5, 6 intersect, pieces from one track may be transferred to another track in a random or predetermined order. Thus, consider piece B-1, which is located at the upper, left-hand point of intersection of tracks 5,6 as viewed in FIG. 1. Piece B-1 can be moved upwardly or downwardly by moving any piece B in track 6 upwardly or downwardly or piece B-1 can be moved to the right or left by moving any piece B in track 5 to the right or left. Piece B-1 can join the pieces B in track 6 in any of its four vertical legs depending on whether piece B-1 is moved up or down immediately or whether it is first moved to the right along track 5 and then moved up or down.

Accordingly, it can be seen that the movement of any given piece from its present position to any other position is a function of the direction and extent of movement in the horizontal and vertical directions. If the pieces B carry indicia, so that they can be distinguished from one another, a puzzle game of varying levels of complexity is achieved.

For example, in the "starting" position all pieces B may be numbered sequentially, starting with piece B-1 and proceeding clockwise around tracks 6 and 5. Further, each of the pieces B surrounding an interior portion 3*a*, 3*b*, 3*c*, 3*d* may be of a different color, or of two different colors, thus providing four or eight colors, respectively. After the pieces B are moved randomly through several combinations of up/down/right/left movements, the object of the puzzle may be to restore the pieces B to their original pattern of colors, or to the original numerical sequence, or to any other predetermined goal.

The puzzle game of the invention need not be two-dimensional. Thus, FIG. 5 shows a spherical game 30 having two endless tracks 31, 32 filled with pieces B. Tracks 31, 32 are shown as great circles that intersect at two points, the hidden second point of intersection being diametrically opposite the visible point. Tracks 31, 32 are provided by mounting face portions 33–36 on a spherical support member 37 that is provided with two circular grooves 38 sufficiently wide and deep to allow the lower portion 20 of each piece B to freely move in the groove 38. Support member 37 is conveniently formed by molding a plastic material to the desired shape. A rigid plastic foam, such as a polyurethane foam, is presently preferred as the support member 37.

Figure 6:
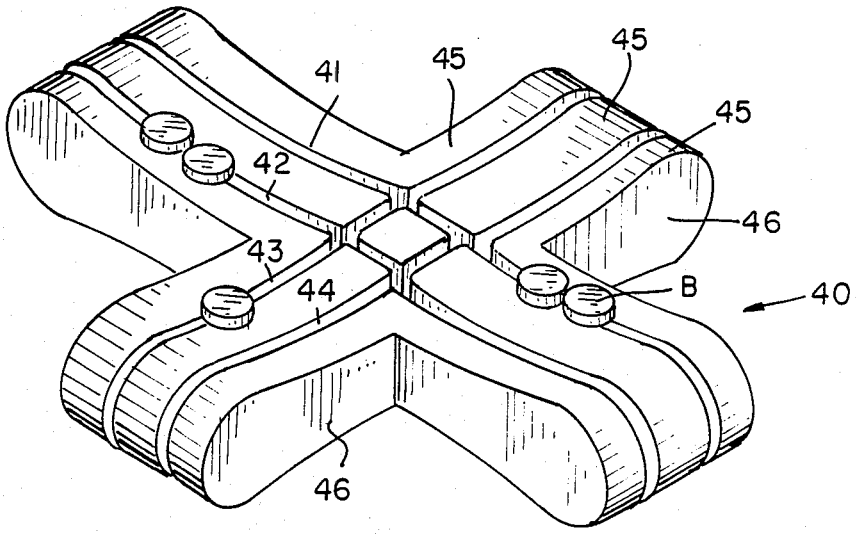
FIG. 6 is a perspective view of another embodiment of the invention.

Game 40 (FIG. 6) has four endless tracks 41–44 that intersect at eight points, with one pair of four points being at the top of the game and the other pair (not shown) being at the bottom. As in game 30, face portions 45 are mounted on a plastic support member 46 that has grooves (not shown) in its outer surface of a width and depth to allow pieces B to move along the tracks 41–44. Tracks 41–44 are in the shape of ellipses having opposing long sides that converge toward one another at their midpoint, and hence are stylized infinity signs.

Figure 7:
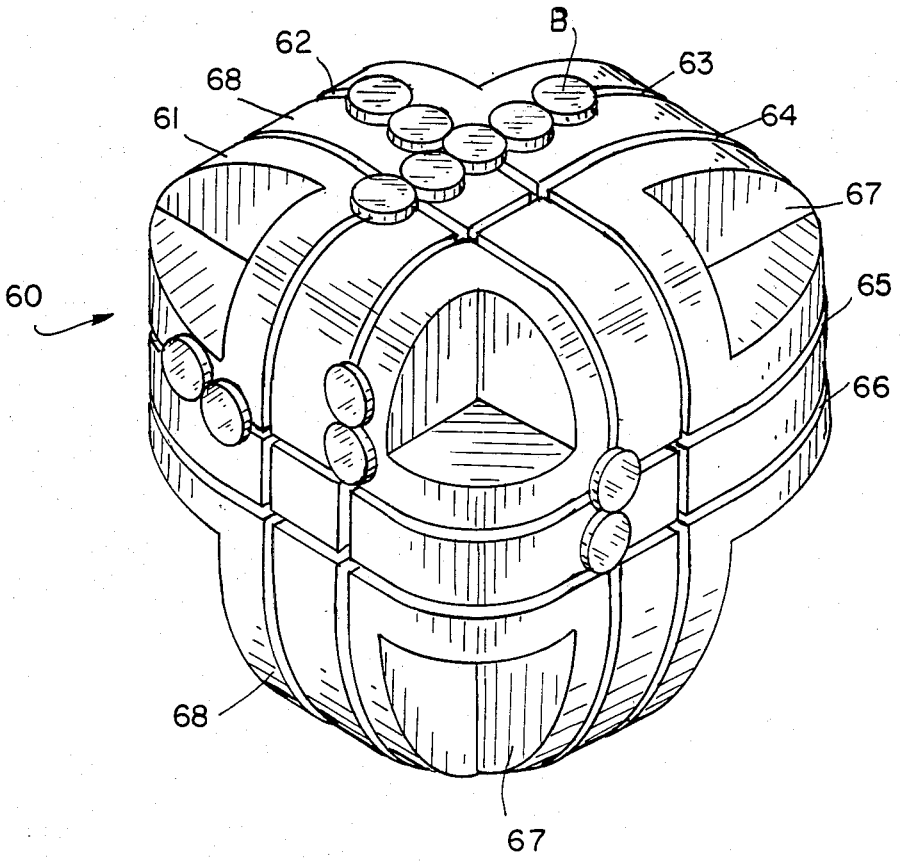
FIG. 7 is a perspective view of another embodiment of the invention.

Game 60 (FIG. 7) has six endless tracks, 61–66 that intersect at 24 points of intersection, namely four such points at each of the six faces of game 60. Game 60 employs a molded plastic support 67 having grooves (not shown) in its outer surface to allow pieces B to slide along the tracks. Face portions 68 are mounted on support 67 and spaced apart from one another to provide tracks 61–66. Support 67 is a cube having eight portions cut away, one at each vertex, and having rounded edges to allow for a smooth transition of the pieces B as they move along the tracks from face-to-face of the cube.

Preferably, pieces B and top or face portions 2, 3*a*–3*d* and 4 (FIGS. 1–4), 33–36 (FIG. 5), 45 (FIG. 6) and 68 (FIG. 7) are made or are coated with plastic to facilitate sliding movement of pieces B along the tracks.

Any of the games 1, 30, 40 and 60 can have more tracks than is shown, and games 40 and 60 can have fewer tracks. While it is preferred that the tracks intersect at right angles, the angle between the tracks at the points of intersection need not be 90°; all that is required is that the tracks intersect in such a manner as to provide transfer points that enable a piece B to be transferred from one track to the other.

What is claimed:

1. A game comprising a. a three-dimensional support of cruciform shape;

b. a plurality of track means carried by said support and lying in separate, intersecting planes, each said track means defining separate, endless courses; and c. a plurality of movable game pieces operatively associated with each said track means for movement along the courses defined by said track means, said game pieces occupying substantially the entire extent of said track means;

said track means being operable to allow a game piece to be selectively moved through a point of intersection between two said track means and to transfer from one course to another or to remain on its original course.

2. A game comprising:

a. A three-dimensional support;

b. first, second and third sets of intersecting track means carried by said support, each set of track means comprising at least two separate, endless courses, said first, second and third sets of track means lying in first, second snd third sets of parallel planes, respectively, said first, second and third sets of parallel planes being mutually perpendicular to one another, and said track means intersect one another to provide at least 24 points of intersection; and c. a plurality of movable game pieces operatively associated with each said track means for movement along the courses defined by said track means, said game pieces occupying substantially the entire extent of said track means; said track means being operable to allow a game piece to be selectively moved through a point of intersection between two said track means and to transfer from one course to another or to remain on its original course.

* * * * *